United States Patent [19]

Brunken et al.

[11] 4,287,735

[45] Sep. 8, 1981

[54] KEY ASSEMBLY FOR CODED SECURITY SYSTEM

[75] Inventors: Gerd Brunken, Dittelbrunn; Rupert Stangl, Oberwerrn, both of Fed. Rep. of Germany

[73] Assignee: Sachs Systemtechnik GmbH, Fed. Rep. of Germany

[21] Appl. No.: 89,467

[22] Filed: Oct. 30, 1979

[30] Foreign Application Priority Data

Nov. 9, 1978 [DE] Fed. Rep. of Germany ... 7833265[U]

[51] Int. Cl.[3] ..... E05B 19/04; E05B 19/18

[52] U.S. Cl. ..... 70/395; 70/408; 70/411

[58] Field of Search ..... 70/395, 411, 408, 409

[56] References Cited

U.S. PATENT DOCUMENTS 1,318,837 10/1919 Brandaleone ..... 70/411
2,038,677 4/1936 Recht .
2,430,914 11/1947 Ciami ..... 70/411

FOREIGN PATENT DOCUMENTS 2138991 2/1973 Fed. Rep. of Germany .
2400550 1/1974 Fed. Rep. of Germany ..... 70/411
2727126 6/1977 Fed. Rep. of Germany ..... 70/411

*Primary Examiner*—Robert L. Wolfe
*Attorney, Agent, or Firm*—Toren, McGeady and Stanger

[57] ABSTRACT

A key assembly for operating a coded security system is structured with a plurality of information carrier members mounted on a longitudinal member of the key assembly and angularly arranged thereon to define a code for a security system operated by the key. Alteration of the code is effected by changing the relative orientation of the information carrier members by threadedly loosening the longitudinal member upon which the carrier members are held, readjusting the position of the carrier members and tightening the longitudinal member to hold the information carrier members fixed in a desired relative position defining the code.

7 Claims, 2 Drawing Figures

KEY ASSEMBLY FOR CODED SECURITY SYSTEM

BACKGROUND OF THE INVENTION

The present invention relates to the security systems and more particularly to the structure of a key defining a code for operating a coded security system. More particularly, the invention is directed toward the structure of a key having a grip portion upon which there are held a plurality of information carrier members which may be rotated relative to each other in a predetermined angular pattern to establish the code of the security system.

Keys of this type are known from German Pat. No. 2138991. The secret code of the key is determined by the relative angular positioning of a plurality of information carrier members which comprise magnetic devices. The key usually will operate a mechanical lock having tumblers which are unlocked by switch magnets located in the lock housing when a magnetic field with a predetermined direction is applied to the switch magnet by means of the key. The known key has two magnets which are arranged in a plane adjacent each other and which are held on locking discs. The magnets may be rotated about an axis which extends perpendicularly to the direction of magnet polarization. By rotating the locking discs, the angular position of the direction of polarization relative to each of the carrier members may be changed and the key may be coded to a desired code.

A disadvantage of the known key structure is the disproportionately increasing space requirement of the key when a higher number of coding variations must be provided. Moreover, adjustment of the locking discs may be relatively easily changed which is undesirable from the point of view of utilization of the key.

The invention is directed toward providing a relatively small key having a relatively higher number of coding variations wherein the secret code of the key may be changed in a simple manner while still providing protection against unintentional changes in the code.

SUMMARY OF THE INVENTION

Briefly, the present invention may be described as a key assembly particularly suitable for operating a coded security system comprising a plurality of information carrier members mounted on the key and adapted to be arranged in a predetermined pattern relative to each other for defining an operating code of the security system, a grip portion, a longitudinal member having the information carrier members rotatably supported thereon, a head portion on the longitudinal member cooperating with the grip portion for fixedly holding the information carrier members in place on the longitudinal member, means mounting the longitudinal member in the grip portion for axial nonrotational movement relative thereto, and means for moving the head portion between a first position where the information carrier members are fixedly held in place on the key assembly and a second position where the information carrier members may be moved relative to each other to enable alteration of the code.

In accordance with the foregoing, the invention enables changing of the key code with increased ease by virtue of the fact that the information carrier members are rotatably supported on the longitudinal member adjacent each other between the grip portion of the key and the head portion of the longitudinal member. Axial movement of the head portion may be effected by axial movement of the longitudinal member which will loosen the information carrier members and enable them to be angularly rearranged on the longitudinal member for changing the code. Supported in the grip portion is a sleeve which is provided with an internal thread and which is accessible from outside of the grip portion, the sleeve being axially fixed relative to the grip portion but rotatable about an axis of rotation which is parallel to the direction of movement of the longitudinal member. The longitudinal member is provided with an external thread which is threadedly engaged with the sleeve. The information carrier members are normally nonrotatably clamped between the head of the longitudinal member and the grip portion. By rotation of the sleeve, the longitudinal member may be unscrewed out of the grip portion whereby the information carrier members are released and may be rotated relative to each other in accordance with a desired secret code of the key. After adjustment of the secret code of the key, the information carrier members are again fixed by opposite rotation of the sleeve. The information carrier members are preferably cylindrical rings or annular members and for securing the carrier members against rotation, friction surfaces or locking members may be provided for insuring a locking engagement between the information carrier members.

The information provided on the information carrier members may be magnetic, optical or mechanical information which may be scanned by appropriate reading elements of the security system or of a lock with which the key may be utilized. In the case where the coded information is magnetic in nature, reverberation probes are particularly suitable. Optical information may be formed by different reflecting surface areas of the information carrier members. In this case, the lock or security system may comprise a light source which illuminates these regions and a plurality of photodetectors.

A version of the key assembly of the invention, which may be produced with relatively low cost and which is particularly relatively easy to assemble, is one wherein the grip portion has a main body and an insert which is held in locking engagement in a recess of the main body by means of locking members, with the sleeve carrying a radially projecting flange at its end facing toward the information carrier members and being rotatably arranged in a bearing opening of the insert, the flange being held axially between stop faces of the insert which face each other, and a main body or part inserted in the recess.

Protection against unintentional release of the longitudinal member and of unintenional release of the information carrier members is significantly increased when the sleeve projects beyond the grip portion on the side which faces away from the information carrier members, wherein a cap covering the projecting portion of the sleeve is removably engaged on the grip portion.

In a preferred embodiment of the invention it is provided that the grip portion include a guide edge which is covered in a locking manner by the cap with the cap carrying a detent which acts in a locking manner on the projecting portion of the sleeve. The detent clamps the sleeve against the cap and the cap is, in turn, nonrotatably held on the grip portion by means of the guide edge. The detent is preferably constructed as a tubular projection which covers the sleeve and which, if necessary, may be axially slotted to improve its clamping action.

In order to facilitate manipulation of the key, the portion of the sleeve projecting beyond the grip portion may be provided with a toothed configuration with a complementary toothed configuration being provided on the outer side of the cap so that the cap may be utilized as a tool for fixing and releasing the longitudinal member. Any type of toothed arrangement would be suitable but a toothed arrangement in the shape of a cross is preferred since relatively high torque may be transmitted by means by such a toothed arrangement without the danger that the teeth may be broken during use.

The complementary toothed arrangement may be advantageously countersunk in a pocket of the cap so that the key will maintain an essentially smooth outer contour.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DESCRIPTION OF THE PREFERRED EMBODIMENTS

Figure 1:
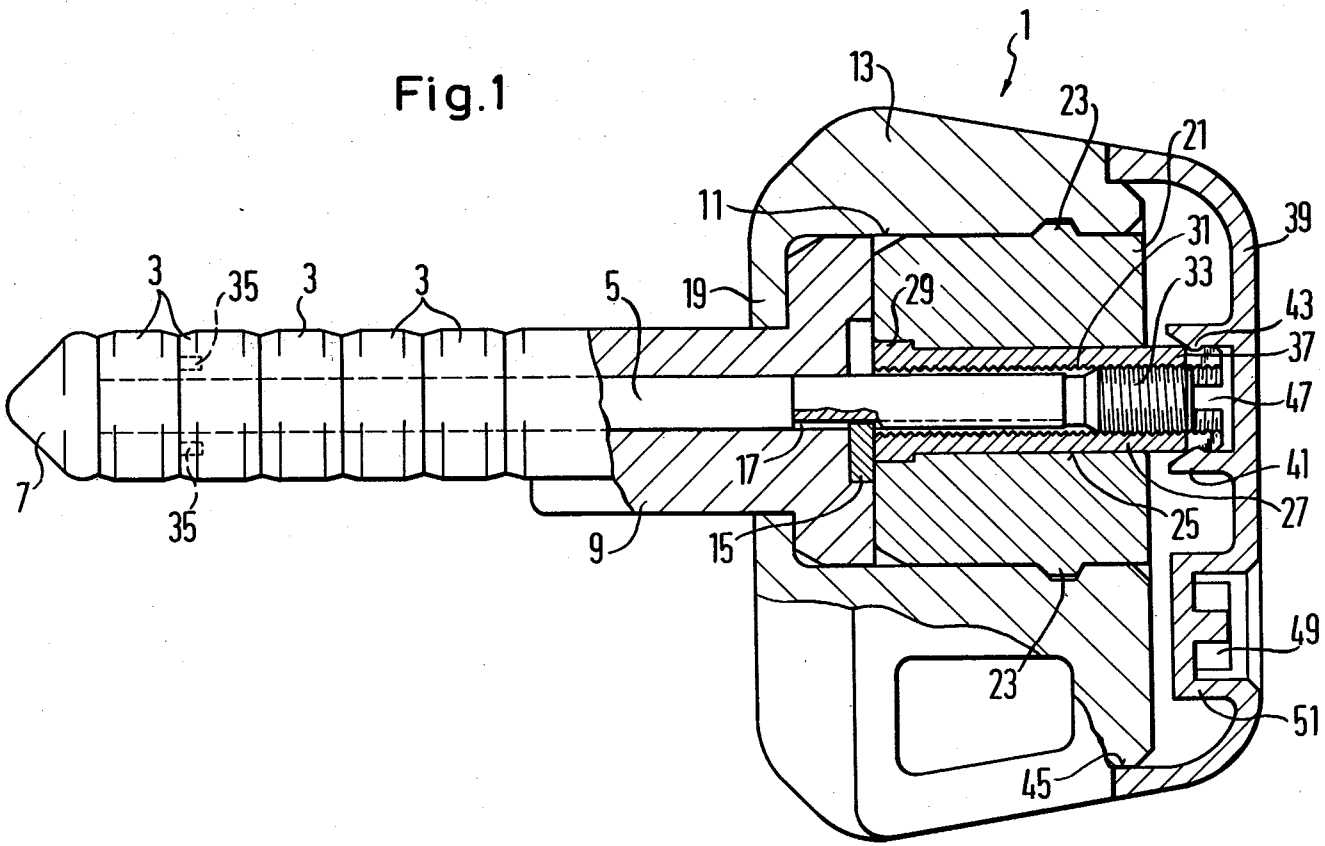
FIG. 1 is a longitudinal view partially in section taken through a key assembly embodying the invention.

A key assembly structured in accordance with the present invention and illustrated in the drawings, particularly in FIG. 1, includes a grip portion 1 upon which there are mounted a plurality of information carrier members 3. The carrier members 3 are each formed with an annular configuration and they are rotatably mounted upon a longitudinal member 5. The carrier members 3 may thus be rotated relative to each other to a predetermined angular pattern which will establish a predetermined code for the key. The information carrier members 3 are constructed as symmetrical rings and distributed over their circumference in the angular pattern the rings carry magnetic, optical or electrical information which may be scanned by an appropriately adjusted reading device of a security system or lock with which the key may be utilized. The secret code of the lock or security system may be adjusted by rotation of the information carrier members 3.

The information carrier members 3 are axially arranged adjacent each other on the longitudinal member 5 between a head portion 7 of the longitudinal member 5 and a guide projection 9 of the grip portion 1. The guide projection or insert 9 is arranged in a locking manner in a recess 11 of a main body 13 of the grip portion 1 and axially movably guides the longitudinal member 5. A pin 15 is held in a locking manner in a recess of the guide insert or projection 9 and it engages an axial groove 17 formed in the longitudinal member 5 in order to secure the member 5 against rotation relative to the grip portion 1.

The guide insert 9 is arranged between a collar or flange 19 of the main body 13, the flange 19 extending radially inwardly from the main body 13 to define an edge or border of the recess 11, and an insert 21 which is locked within the recess 11 by means of locking members 23 with the guide insert 9 being axially fixed. A sleeve 27 rotatably arranged within a cylindrical recess 25 extends coaxially with the longitudinal member 5. The sleeve 27 has an annular flange 29 on the end thereof facing toward the guide insert 9. The annular flange 29 is arranged between opposing stop faces of the guide insert 9 and the insert 21 and operates to fix the sleeve 27 in the axial direction. The sleeve 27 has an internal thread 31 into which an external thread 33 of the longitudinal member 5 is engaged. By rotation of the sleeve 27, the longitudinal member 5 may be moved outwardly of the grip portion 1 so that fixing of the information carrier parts 3 is released and so that the carrier parts or members 3 may be rotated relative to each other on the longitudinal member 5. By rotation in the opposite direction, the information carrier parts are then fixed in the chosen angular position. On their axially located end faces, the information carrier parts may be provided with friction surfaces or with locking members as illustrated, for example, mortise-and-tenon joint, at 35. However, the invention may utilize a different design for the locking members.

On the side of the grip portion 1 facing away from the information carrier members 3, a portion 37 projects beyond the insert 21. A cap 39 covers the projection 37 with the cap 39 carrying a slotted tubular projection 41 which covers the portion 37 in a locking manner. A bulge 43 at the inner circumference of the annular projection 41 engages a corresponding annular groove of the portion 37 and locks the cap 39 on the sleeve 27. The cap 39, in turn, covers and engages in a locking manner a guide edge 45 at the outer circumference of the main body 13 so that the cap may also be secured against rotation.

Figure 2:
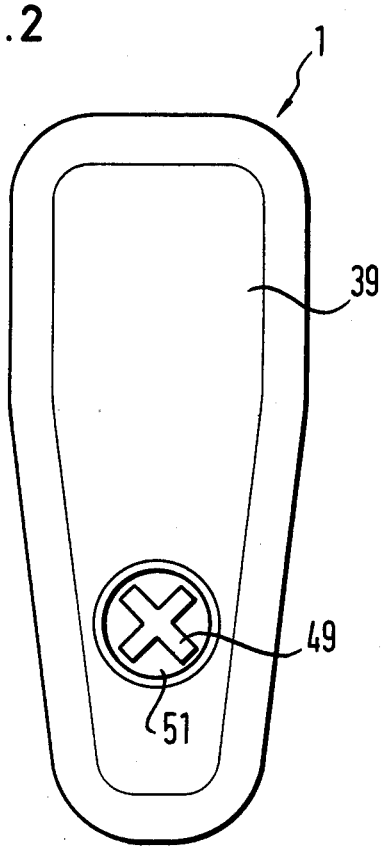
FIG. 2 is a top view of the key assembly shown in FIG. 1.

The projecting portion 37 of the sleeve 27 carries a crossed toothed arrangement 47 formed by radial slots with a complementary toothed arrangement 47 which is accessible from outside of the cap 49 operating to fit into the toothed arrangement 47. The complementary toothing 49 is countersunk in a pocket 51 of the cap 39 and, after the cap 39 is removed from the main body 13, it may be fitted onto the crossed toothed arrangement 47. Accordingly, the cap 39 may serve as a tool for tightening or releasing the longitudinal member 5. The complementary toothing 49 may best be seen in FIG. 2 which illustrates a top view of the cap of the grip portion 1.

Each of the information carrier members 3 may carry a magnet (not shown) with the angular position of each magnet relative to the other magnets on the assembly operating to define the secret code of the key, which code may be sensed or read by a reading device which may, for example, be equipped with reverberation probes. The reading device will determine whether or not a predetermined pattern of positions of the key are occupied by magnets and will deliver a signal code which is compared with a predetermined code signal in a comparator in order to establish whether a match exists. The determination of whether the code established on the key matches a code which has been preprogrammed into the security system or lock with which the key is utilized will determine whether the key is appropriate for operating the lock or security system. Of course, a mismatch would also be determined.

It should be understood, that in accordance with the present invention, optical or electrical means may be utilized instead of magnets in order to form the information pattern establishing the secret code of the key.

While specific embodiments of the invention have been shown and described in detail to illustrate the application of the inventive principles, it will be understood that the invention may be embodied otherwise without departing from such principles.

What is claimed is:

1. A key assembly particularly for operating a coded security system comprising: a plurality of information carrier members mounted on said key assembly and adapted to be arranged in a predetermined pattern for defining an operating code of said security system; a grip portion; a longitudinal member having said information carrier members rotatably supported thereon; a head portion on said longitudinal member cooperating with said grip portion for fixedly holding said information carrier members in place on said longitudinal member; means mounting said longitudinal member in said grip portion for axial nonrotational movement relative thereto; means defining a threaded portion on said longitudinal member; and a threaded sleeve member accessible from outside said grip portion threadedly engaging said threaded portion of said longitudinal member, said sleeve being axially fixed relative to said grip portion but rotatable relative thereto about an axis parallel to the direction of axial movement of said longitudinal member; said sleeve being operative to move said longitudinal member relative to said grip portion to enable loosening of the fixed engagement of said information carrier members for reorganizing the predetermined pattern thereof when it is desired to change said operating code; said grip portion including a main body, said key assembly further including an insert held in a locked manner in a recess of said main body by means of locking members, said sleeve carrying on its end facing toward said information carrier members a radially projecting flange, with said sleeve being rotatably arranged in a bearing opening of said insert, said flange being axially fixed between a pair of opposing stop faces defined within said grip portion.

2. A key assembly particularly for operating a coded security system comprising: a plurality of information carrier members mounted on said key assembly and adapted to be arranged in a predetermined pattern for defining an operating code of said security system; a grip portion; a longitudinal member having said information carrier members rotatably supported thereon; a head portion on said longitudinal member cooperating with said grip portion for fixedly holding said information carrier members in place on said longitudinal member; means mounting said longitudinal member in said grip portion for axial nonrotational movement relative thereto; means defining a threaded portion on said longitudinal member; and a threaded sleeve member accessible from outside said grip portion threadedly engaging said threaded portion of said longitudinal member, said sleeve being axially fixed relative to said grip portion but rotatable relative thereto about an axis parallel to the direction of axial movement of said longitudinal member; said sleeve being operative to move said longitudinal member relative to said grip portion to enable loosening of the fixed engagement of said information carrier members for reorganizing the predetermined pattern thereof when it is desired to change said operating code; said sleeve projecting beyond said grip portion on a side thereof facing away from said information carrier members, with said grip portion having removably mounted thereon a cap which covers said projecting portion of said sleeve.

3. A key assembly according to claim 2 wherein said grip portion is formed with a guide edge having said cap in lcoking engagement therewith, with said cap carrying a detent acting in a locking manner on said projecting portion of said sleeve.

4. A key assembly according to claim 3 wherein said detent is a tubular projection covering said sleeve.

5. A key assembly according to claim 2 wherein said portion of said sleeve projecting beyond said grip portion is provided with a toothed arrangement and wherein a complementary toothed arrangement is provided on the outer side of said cap.

6. A key assembly according to claim 5 wherein said complementary toothed arrangement on said cap is arranged in a countersunk formation in a pocket of said cap.

7. A key assembly according to claim 5 wherein said toothed arrangement and said complementary toothed arrangement are contructed in interfitting crossed configurations.

* * * * *